United States Patent [19]

Manson

[11] 4,335,544

[45] Jun. 22, 1982

[54] STONE-POSITIONING APPARATUS AND METHOD

[75] Inventor: Ernest T. Manson, Indianapolis, Ind.

[73] Assignee: RCA Corporation, New York, N.Y.

[21] Appl. No.: 172,758

[22] Filed: Jul. 28, 1980

[51] Int. Cl.[3] ..... B24B 9/16

[52] U.S. Cl. ..... 51/277; 51/229; 51/281 R; 29/559

[58] Field of Search ..... 269/6; 279/50; 51/229, 51/277, 281 R; 29/559

[56] References Cited

U.S. PATENT DOCUMENTS

| | | | |
|---|---|---|---|
| 633,852 | 9/1899 | Kendrick | 279/50 |
| 1,988,887 | 1/1935 | Armstrong | 51/217 R |
| 1,998,642 | 4/1935 | Smith | 51/229 |
| 2,275,512 | 3/1942 | Dinhofer | 51/229 |
| 2,438,797 | 3/1948 | Bagge | 269/6 |
| 3,380,200 | 4/1968 | Kirwin | 51/219 R |
| 4,142,332 | 3/1979 | Clarke | 51/219 R |

*Primary Examiner*—Harold D. Whitehead

*Attorney, Agent, or Firm*—Birgit E. Morris; Donald S. Cohen; Thomas H. Magee

[57] ABSTRACT

A technique for positioning a stone utilizes a pencil comprising a shaft having at one end a handle and at the opposite end supporting means adapted to hold a stone upon the application of a closing force thereto. The shaft has apparatus for adjusting the length thereof, and a housing fitted over the shaft between the ends thereof in a manner allowing the shaft to be frictionally rotated therein. The housing has apparatus for applying the closing force, disposed at one end thereof adjacent the supporting means, and is adapted to provide the closing force when the shaft is moved longitudinally along the housing.

9 Claims, 7 Drawing Figures

STONE-POSITIONING APPARATUS AND METHOD

This invention relates to a technique for positioning a stone wherein the location and orientation of the stone may be quickly and accurately established.

BACKGROUND OF THE INVENTION

Information playback systems frequently utilize a stylus for reading signals from the surface of an information record, typically a plastic disc, that contains stored video and audio information. In some systems the information record has a fine spiral groove to guide the tip of a stylus that contains a thin electrode. In these systems, the stylus tip is made of a material having sufficient hardness to withstand the abrasion caused from tracking the groove. Materials which possess such hardness, for example diamond, generally have a crystallographic structure which presents surfaces exhibiting different qualities depending upon which crystallographic planes the surfaces are oriented along. Consequently, in manufacturing styli from these crystallographic materials for use in video disc playback systems, it is important to know and maintain the tip orientation during the various processing steps in order to achieve uniform styli of high quality.

The stylus tip is typically fabricated from a relatively small stone, e.g., a diamond stone, which is supported in a work holder during the processing steps. Such a work holder should be capable of firmly holding the stone, but still provide for ease of insertion or removal of the stone. The present invention provides a novel stone-positioning apparatus and method which meets the aforementioned criteria, and also facilitates the rapid positioning of the stone during the various processing steps, including crystallographic orientation and microscopic inspection of the stone.

SUMMARY OF THE INVENTION

The present invention comprises a technique for positioning a stone utilizing a pencil which includes a shaft having at one end a handle and at the opposite end supporting means adapted to hold a stone upon the application of a closing force thereto. The shaft has means for adjusting the length thereof, and a housing fitted over the shaft between the ends thereof in a manner allowing the shaft to be frictionally rotated therein. The housing has means for applying the closing force, disposed at one end thereof adjacent the supporting means, and is adapted to provide the closing force when the shaft is moved longitudinally along the housing.

DETAILED DESCRIPTION OF THE INVENTION

Figure 1:
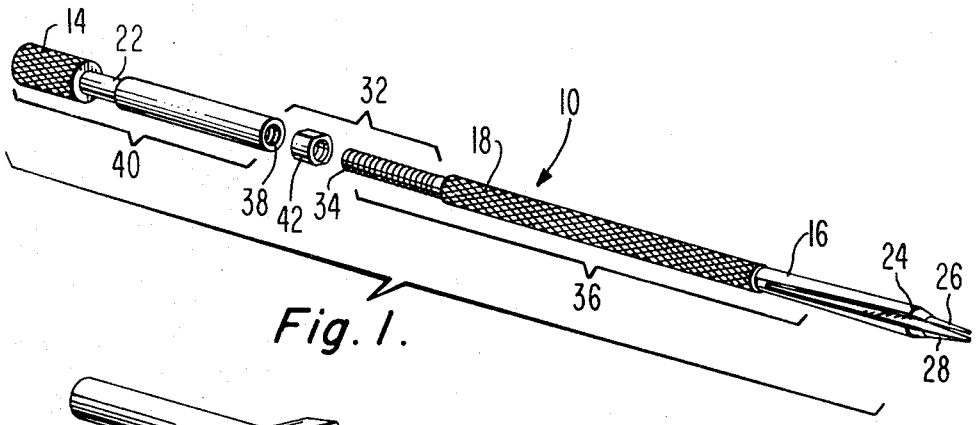
FIG. 1 is an exploded perspective view of the shaft of the novel stone-positioning pencil.
Figure 3:
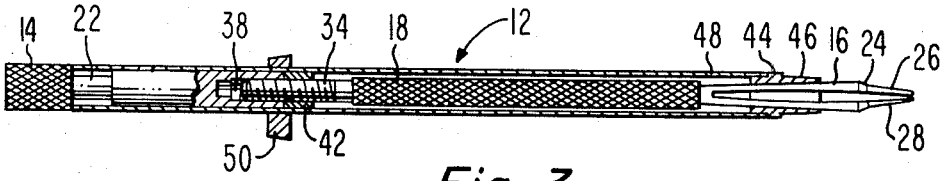
FIG. 3 is a partial cross-sectional view of the stone-positioning pencil assembled.

In FIG. 1 of the drawing, there is illustrated a shaft 10 which comprises one element of the novel stone-positioning pencil 12, shown assembled in FIG. 3. The shaft 10 has at one end a handle 14 and at the opposite end supporting means 16 adapted to hold a stone (not shown) upon the application of a closing force thereto. In the present embodiment the shaft 10 comprises a metallic cylindrical rod 18 wherein the handle 14 includes a knurl at the one end. Adjacent the handle 14 is an undercut groove 22 adapted to receive means for preventing the movement of the rod 18 along its longitudinal axis, as further explained below.

In the present embodiment, the supporting means 16 comprises a split collet 24 having two flexible jaws 26 and 28 for holding the stone. The collet 24 has a tapered diameter shaped to allow one end of a housing 30, shown in FIG. 2, to transmit a closing force to the jaws 26 and 28 when the shaft 10 pulls the collet 24 into the one end of the housing 30.

The shaft 10 further comprises means 32 for adjusting the length of the shaft 10. In the preferred embodiment, the adjusting means 32 comprises an external screw thread 34 disposed in a first portion 36 of the shaft 10 and mated with an internal screw thread 38 disposed in a second portion 40 of the shaft 10. The overall length of the shaft 10 may then be varied by rotating the external thread 34 with respect to the internal thread 38. In the present example, the shaft 10 further includes a nut 42 disposed on the external screw thread 34 for tightening against the second portion 40 of the shaft 10 in order to fix the position of the external thread 34 with respect to the internal thread 38, and thereby maintain the adjustable shaft 10 at a predetermined length.

Figure 2:
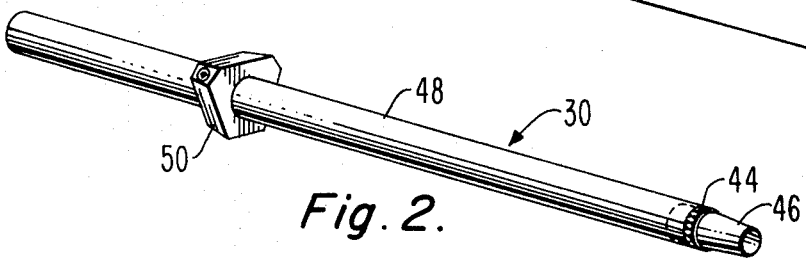
FIG. 2 is a perspective view of the housing utilized in the stone-positioning pencil for fitting over the shaft.

In FIG. 2 there is shown the second element of the novel stone-positioning pencil 12 which comprises a housing 30 for fitting over the shaft 10 between the ends thereof as shown in FIG. 3, in a manner allowing the shaft 10 to be frictionally rotated therein. The housing 30 has means 44 for applying the closing force disposed at the one end adjacent the supporting means 16. The applying means 44 is adapted to provide the closing force when the shaft 10 is moved longitudinally along the housing 30. In the present embodiment the applying means 44 comprises an annular collar 46, and the housing 30 comprises a cylindrical tube 48 made of aluminum. In the present embodiment, the annular collar 46 comprises a collet closer, available commercially as Bergeon No. 30142 from Bergeon, Zurich, Switzerland, which has been slightly machined to allow it to be press fitted into one end of the cylindrical tube 30, as shown in FIG. 2. The collar 46 is shaped so as to transmit a radial closing force to the jaws 26 and 28 when the shaft 10 pulls the collet 24 into the one end of the tube 48. In other words, as the tapered collet 24 is pulled into the collar 46, the collar 46 forces the jaws 26 and 28 of the collet 24 closer together to allow a stone to be firmly held therebetween.

In the present embodiment, the pencil 12 further comprises a positioning ring 50 disposed around the tube 48. The positioning ring 50 has a relatively tight fit with the tube 48, but is capable of being frictionally rotated about the tube 48. For additional information on such a positioning ring, see U.S. patent application entitled WORK HOLDER, Ser. No. 118,214, filed on Feb. 4, 1980, and assigned to RCA Corporation. The assembled stone-positioning pencil 12 is shown in FIG. 3.

Figure 4:
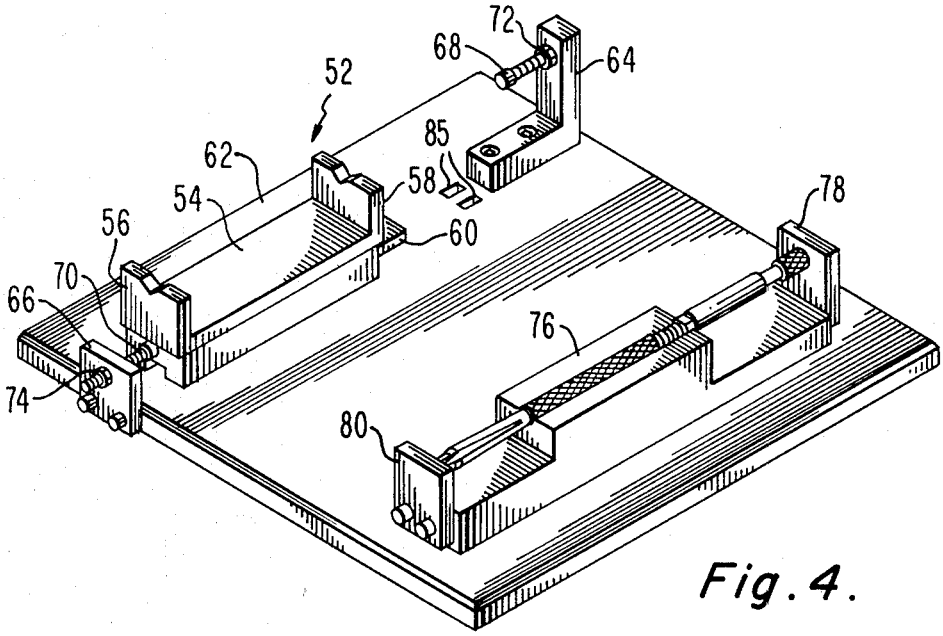
FIGS. 4 through 7 are a series of perspective views illustrating different steps in a method of positioning a stone utilizing the present novel apparatus.

In FIG. 4 of the drawing, there is shown an apparatus 52 for positioning a stone in the novel pencil 12. The apparatus 52 comprises a holder 54 adapted to support the pencil 12 in a manner wherein the two ends of the pencil 12 extend beyond a front and a rear surface 56 and 58 of the holder 54. The holder 54 is mounted on means 60 for guiding the holder 54 along a direction parallel to the longitudinal axis of the supported pencil 12. The guiding means 60 is affixed to a platform 62.

A pencil stop 64 is affixed to the platform 62 in a position facing the rear surface 58 of the holder 54 and adapted to contact one end of the supported pencil 12 and thereby limit the movement of the pencil 12 along a direction parallel to its longitudinal axis.

The apparatus 52 further comprises a holder stop 66 affixed to the platform 62 in a position facing the front surface 56 of the holder 54. The holder stop 66 is shaped to allow projection of the supported pencil 12 along its longitudinal axis beyond the holder stop 66 but to contact the front surface 56 of the holder 54 and thereby limit the forward movement of the holder 54.

In the present embodiment, the pencil and holder stops 64 and 66 each have means for changing the position of their contact surface with respect to the platform 62. Preferably, the contact surfaces for the pencil and holder stops 64 and 66 comprise the heads of two threaded bolts 68 and 70 attached thereto, respectively, having their shafts aligned in a direction along the longitudinal axis of the supported pencil. The contact surfaces may then be adjusted by rotating the bolts 68 and 70 to change their positions relative to the platform 62. The bolts 68 and 70 may be held in a fixed position, after adjustment, by tightening nuts 72 and 74, respectively.

The apparatus 52 may further comprise means for gauging the overall length of the pencil 12. In the present example, the gauging means comprises a length-adjusting holder 76, affixed to the platform 62, and two walls 78 and 80 affixed to the platform 62 on opposite sides of the length-adjusting holder 76 for contacting the two ends of the pencil 12, respectively. The purpose of the gauging means is to hold the shaft 10 while its length is adjusted to a predetermined value measured by the distance between the two walls 78 and 80 which contact, respectively, the handle 14 and the supporting means 16, as shown in FIG. 4. The gauging means may also be designed so that the predetermined value for overall length is capable of being adjusted by having the ends stops which contact the shaft 10 comprise screw-adjustable stops (not shown), similar to the bolts 68 and 70, instead of the fixed walls 78 and 80. The apparatus 52 may be fabricated out of typical metal stock by machining to the desired shape, as shown in the drawing.

In FIG. 4, there is shown the first step in the present method of positioning a diamond stone. Preferably, the shaft 10 alone is laid along the gauging means consisting of the length-adjusting holder 76 and the two walls 78 and 80. The adjusting means 32 is then changed in a manner allowing the two ends of the shaft 10 to be positioned flush against the two walls 78 and 80, respectively, whereby the length of the shaft 10 is set at a predetermined value.

Figure 5:
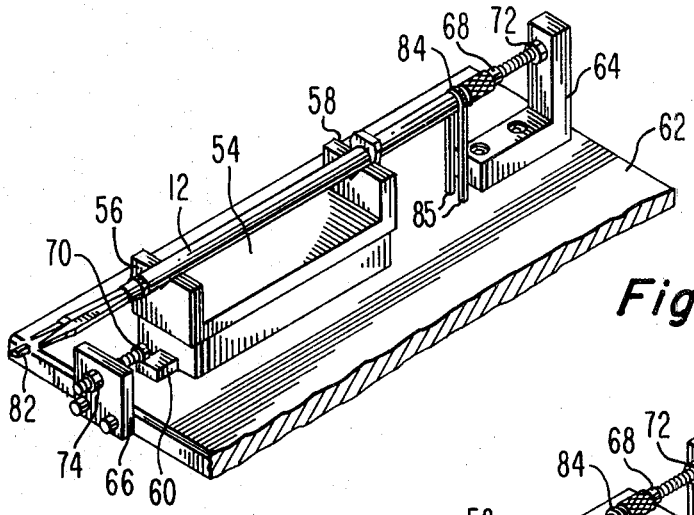

The entire pencil 12 with the supporting means 16 in an open position ready to receive a stone 82, is then placed in the holder 54, as illustrated in FIG. 5. The positioning ring 50 is positioned flush against the rear surface 58 of the holder 54. The holder 54 is then moved backward along the guiding means 60 until the handle 14 of the pencil 12 contacts the pencil stop 64.

Means for preventing the movement of the shaft 10, in a direction along its longitudinal axis, is fastened to the handle 14 of the pencil 12. In the present embodiment, the preventing means comprises a U-shaped yoke 84 which is inserted over the undercut groove 22 adjacent the handle 14, and connected to the platform 62 by inserting the ends of the yoke 84 into recessed holes 85 in the platform 62, as shown in FIG. 5. The U-shaped yoke 84 may be made of any material and may take any shape as long as it is capable of holding the shaft 10 in a manner preventing movement of the shaft 10 in a direction along its longitudinal axis.

The stone 82 is then located within the supporting means 16. This step may be performed easily by utilizing a microscope (not shown) which is focussed on the split collet 24 at the ends of the flexible jaws 26 and 28. While looking through the microscope, an operator may pick up the stone 82 with a pair of tweezers (not shown) and position the stone between the open jaws 26 and 28, as shown in FIG. 5.

Figure 6:
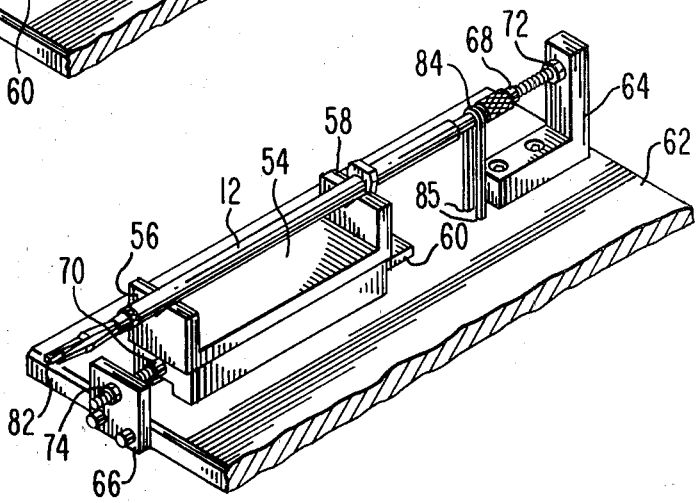

While maintaining the stone between the open jaws 26 and 28, the housing 30 and supporting pencil holder 54 are slid forward along the guiding means 60, while the shaft 10 remains stationary. Preferably, this sliding step is performed manually by an operator who simply grasps the housing 30 and supporting holder 54 and then slides them forward; the shaft 10 remains stationary since it is held by the preventing means, i.e., the U-shaped yoke 84 in the present embodiment. The housing 30 and holder 54 are slid forward until the front surface 56 of the holder 54 contacts the holder stop 66, whereby the housing 30 transmits a closing force to the supporting means 16, i.e., the jaws 26 and 28 in the present example, thereby causing the stone 82 to be held firmly between the two closed jaws 26 and 28, as shown in FIG. 6. Although the stone 82 actually contacts the jaws 26 and 28 in the drawing, the present invention is also applicable to positioning other workpieces including a synthetic stone held by a metallic shank, in which case the jaws 26 and 28 may hold the stone in position by actually contacting the shank only.

Figure 7:
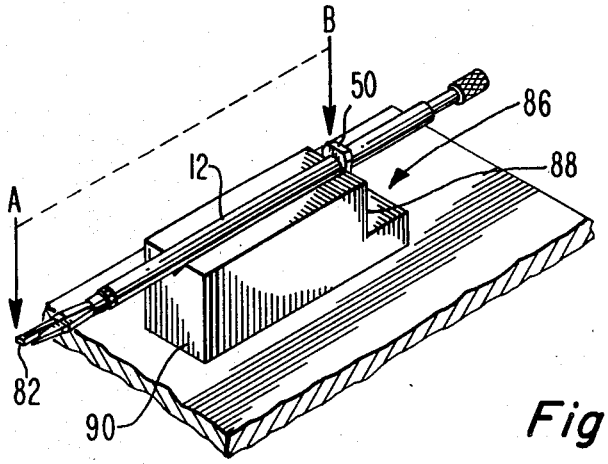

The pencil 12 may now be removed from the positioning apparatus 52 and carried to another work station 86 where the stone 82 is positioned in an optical alignment apparatus (not shown) at A by simply placing the positioning ring 50 of the pencil 12 flush against the surface 88 of a positioning block 90 at B disposed at that station, as shown in FIG. 7. The optical element of the alignment apparatus positioned at A, i.e., the portion thereof that views the facets of the stone 82, is then automatically aimed at the tip of the stone 82, since the alignment apparatus at A is set at a predetermined distance from the surface 88 disposed at B, and since the stone 82 has already been placed at a distance from the positioning ring 50 equal to this predetermined distance, represented by the distance from A to B. The optical alignment apparatus may then be utilized to align a facet of the stone 82 along a predetermined plane by simply rotating the shaft 10 of the novel pencil 12 within the housing 30 until a desired facet orientation is achieved.

The pencil 12 may now be removed from the optical alignment apparatus and carried to a work station for performing any one of various processing steps, such as lapping a facet of the stone 82, or visually inspecting the stone 82 under a microscope after a lapping operation. The essence of the present invention is that, whenever the stone 82 is moved from one work station to another, the stone 82 may be rapidly positioned thereat by simply aligning the positioning ring 50 of the novel pencil 12 flush against the surface 88 of the positioning block 90 disposed at that station, as shown in FIG. 7. The machinery at that station, whether it be a lapping disc or an inspecting microscopic camera, is always set at a predetermined distance and orientation from the surface 86 of the positioning block 88. Since the novel apparatus of the present invention allows for the stone 82 to be positioned with a fixed orientation at a precise distance from the positioning ring 50, the machinery is able to "operate" upon the stone 82 while its tip is firmly held at this position, thereby helping to efficiently achieve uniform styli of high quality.

What is claimed is:

1. Apparatus for positioning a stone in a pencil comprising:

a platform, a holder adapted to support said pencil in a manner wherein the two ends of said pencil extend beyond a front and rear surface of said holder, said holder being mounted on means for guiding said holder along a direction parallel to the longitudinal axis of said pencil, said guiding means being affixed to said platform, a pencil stop affixed to said platform in a position facing the rear surface of said holder and adapted to contact one end of said pencil and thereby limit the movement of said pencil along said axis, and a holder stop affixed to said platform in a position facing the front surface of said holder and shaped to allow movement of said pencil along said axis beyond said holder stop, but to contact the front surface of said holder and thereby limit the forward movement of said holder.

2. Apparatus as defined in claim 1 wherein said pencil and said holder stops each have means for changing their contact surface with respect to said platform.

3. Apparatus as defined in claim 2 wherein said changing means comprises a bolt held in a fixed position by a tightening nut.

4. Apparatus as defined in claim 1 further comprising means for gauging the overall length of said pencil, said means including a length-adjusting holder affixed to said platform and two walls affixed to said platform on opposite sides of said length-adjusting holder for contacting the two ends of said pencil, respectively.

5. A method of positioning a stone in a pencil, said pencil including a shaft having at one end a handle and at the opposite end supporting means adapted to hold a stone upon the application of a closing force thereto, and also including a housing fitted over said shaft between said ends in a manner allowing said shaft to be frictionally rotated therein, said housing having means for applying said closing force, disposed at one end thereof adjacent said supporting means, and adapted to provide said closing force when said shaft is moved longitudinally along said housing, comprising the steps of:

placing said pencil, with said supporting means in an open position ready to receive said stone, in a holder adapted to support said housing in a manner wherein the two ends of said housing extend beyond a front and a rear surface of said holder, respectively, and wherein a positioning ring disposed around said housing is positioned flush against said rear surface, said pencil holder being mounted on means for guiding said holder along a direction parallel to the longitudinal axis of said pencil, said guiding means being affixed to a platform, moving said holder backward along said guiding means until the handle of said pencil contacts a pencil stop affixed to said platform in a position facing the rear surface of said holder, fastening to said handle means for preventing the movement of said shaft along said longitudinal axis, locating said stone within said supporting means, and sliding said housing and the supporting pencil holder forward along said guiding means while said shaft remains stationary, until the front surface of said holder contacts a holder stop, affixed to said platform in a position facing the front surface of said holder and shaped to allow movement of said housing along said axis beyond said holder stop, whereby said housing transmits a closing force to said supporting means thereby causing said stone to be held firmly therein.

6. A method as recited in claim 5 wherein said fastening step is performed by inserting a U-shaped yoke over an undercut groove adjacent said handle, said yoke being connected to said platform.

7. A method as recited in claim 5 wherein said shaft has means for adjusting the length thereof, and wherein said method further comprises, prior to said placing step, the steps of:

laying said shaft along means for gauging the overall length of said pencil, said gauging means including a length-adjusting holder affixed to said platform and two walls affixed to said platform on opposite sides of said length-adjusting holder, and changing said adjusting means in a manner allowing the two ends of said shaft to be positioned flush against said two walls, respectively, whereby the length of said shaft is set at a predetermined value.

8. A method as recited in claim 7 wherein said adjusting means comprises an external screw thread disposed in a first portion of said shaft and mated with an internal screw thread disposed in a second portion of said shaft, and wherein said changing step is performed by rotating said external thread with respect to said internal thread.

9. A method as recited in claim 5 further comprising, after said sliding step, the steps of:

positioning said pencil in an optical alignment apparatus by utilizing said positioning ring, and rotating said shaft within said housing to align a facet of said stone along a predetermined plane.

* * * * *